US007108653B2

(12) United States Patent
Mackin

(10) Patent No.: US 7,108,653 B2
(45) Date of Patent: Sep. 19, 2006

(54) CANOPY ADJUSTABLE MOUNTING SYSTEM FOR INFANT WARMING APPARATUS

(75) Inventor: Michael H. Mackin, Ellicott City, MD (US)

(73) Assignee: Datex-Ohmeda, Inc., Madison, WI (US)

( * ) Notice: Subject to any disclaimer, the term of this patent is extended or adjusted under 35 U.S.C. 154(b) by 0 days.

(21) Appl. No.: 10/727,896

(22) Filed: Dec. 4, 2003

(65) Prior Publication Data

US 2005/0124850 A1 Jun. 9, 2005

(51) Int. Cl.
*A61G 11/00* (2006.01)

(52) U.S. Cl. ..... 600/22

(58) Field of Classification Search ..... 600/21, 600/22; 128/205.26, 897, 898
See application file for complete search history.

(56) References Cited

U.S. PATENT DOCUMENTS

| | | | | |
|---|---|---|---|---|
| 1,842,224 | A | 1/1932 | Wells | |
| 3,535,777 | A | 10/1970 | Felts | |
| 3,858,570 | A | 1/1975 | Beld et al. | |
| 4,184,395 | A | 1/1980 | Blachly et al. | |
| 4,453,691 | A | 6/1984 | Hochstatter | |
| 4,958,794 | A | 9/1990 | Brewer | |
| 4,997,155 | A | 3/1991 | Reuter et al. | |
| 5,065,489 | A | 11/1991 | Mullen et al. | |
| 5,090,650 | A | 2/1992 | Donaldson et al. | |
| 5,115,878 | A | 5/1992 | Hayata | |
| 5,214,441 | A | 5/1993 | Blanding et al. | |
| 5,274,732 | A | 12/1993 | Farnand et al. | |
| 5,601,329 | A | 2/1997 | Glagow et al. | |
| 6,022,310 | A | 2/2000 | Goldberg et al. | |
| 6,231,499 | B1 * | 5/2001 | Jones | 600/22 |
| 6,367,476 | B1 | 4/2002 | Conn | |
| 6,669,625 | B1 * | 12/2003 | Costanzo et al. | 600/22 |
| 2002/0032361 | A1 | 3/2002 | Eustace et al. | |
| 2002/0072649 | A1 | 6/2002 | Costanzo et al. | |

* cited by examiner

*Primary Examiner*—Samuel G. Gilbert
(74) *Attorney, Agent, or Firm*—Roger M. Rathbun

(57) ABSTRACT

An infant warming apparatus having a canopy movable with respect to an infant support between a lower position where the canopy mates with an upper peripheral edge of vertical walls extending upwardly from the infant support to enclose the infant in an infant compartment and an upper position opening the infant compartment. There is an adjustable mounting system that allows the canopy to be initially moved along and rotated about various axes in order to align the canopy with the vertical walls during the assembly of the infant warming apparatus. Once properly aligned, the canopy can be fixed in a desired orientation and/or allowed some motion between the canopy and the vertical walls to assure of a correct alignment of the canopy with the walls to create an isolated infant compartment.

8 Claims, 7 Drawing Sheets

FIG. 5
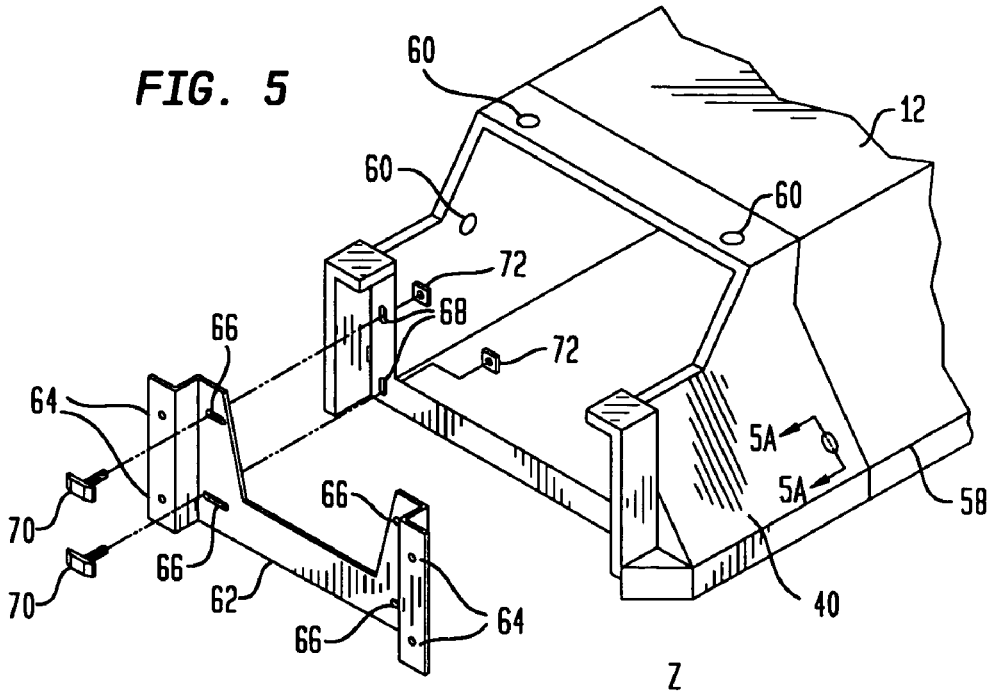
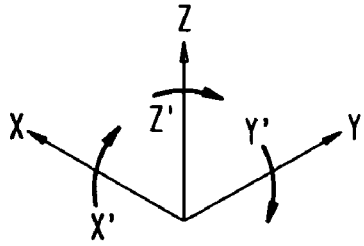
FIG. 6
FIG. 5A
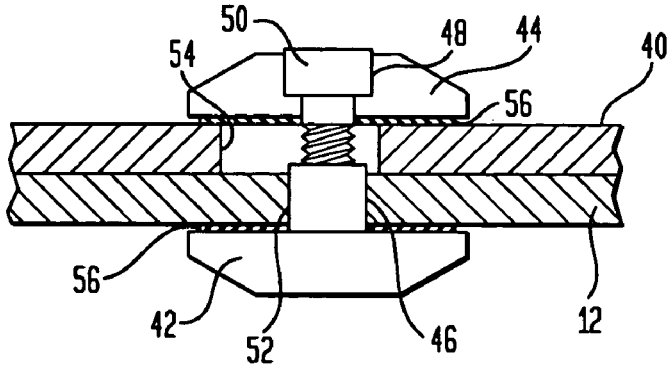

60
60
60
12
76
68
72
64
66
82
80
70
70
66
62
64
78
74
76
40
60

CANOPY ADJUSTABLE MOUNTING SYSTEM FOR INFANT WARMING APPARATUS

BACKGROUND

The present invention relates to an infant warming apparatus and, more particularly, to an apparatus which includes an overhead canopy that is movable with respect to an infant support to convert the apparatus between an infant warmer function and an incubator function.

There are, of course, many devices or apparatus for the warming of an infant and to supply the necessary heat to maintain the infant at a predetermined temperature. Of the various apparatus, there are infant warmers that are basically planar surfaces on which the infant is positioned and which planar surfaces generally include side walls to keep the infant safely within the confines of the apparatus.

Infant warmers normally have an overhead radiant heater that is located above the infant and which thus radiates energy in the infrared spectrum to impinge upon the infant to maintain the infant at a warm, desired temperature. Since the infant is otherwise totally exposed to the surroundings, there is almost unlimited access to the infant by the attending personnel to perform various procedures on that infant. An example of an infant warmer is shown and described in U.S. Pat. No. 5,474,517 of Falk et al as prior art to that patent.

There are also infant incubators and which are more confined enclosures that contain the infant within an enclosed controlled atmosphere in an infant compartment that provides heat to the infant and also may provide control of humidity in the enclosed environment. Such incubators maintain the infant for long periods of time and include handholes to access the infant. Generally, there is, in addition, one or more doors that can be opened to access the infant or to insert or remove the infant to and from the incubator. Such devices provide a good atmosphere to the infant and control that local environment within which the infant is located, however, it is sometime difficult to perform a wide variety of procedures on the infant due to the somewhat limited access to that infant. An example of an infant incubator is shown and described in U.S. Pat. No. 4,936,824 of Koch et al.

At the present, there are also certain infant care apparatus that have both of the aforedescribed functions, that is, the apparatus can operate either as a radiant warmer or an incubator and one such apparatus is shown and described in U.S. Pat. No. 6,213,935 and entitled "Infant Warming Apparatus" of Mackin et al and assigned to the assignee of the present application. In the Mackin et al patent, the apparatus has a canopy with a radiant heater and the canopy and radiant heater can be moved between an upper position where the radiant heater directs the energy in the infrared spectrum towards the infant to provide heat to the infant and a lower position where the radiant heater is disabled and a convective heating system is provided in the infant apparatus to heat the infant now enclosed within an infant compartment covered by the canopy.

An infant apparatus is also shown and described in U.S. Pat. No. 6,224,539 of Jones et al, and assigned to the assignee of the present application. In the Jones et al patent, there is canopy having a radiant heater positioned over an infant support and, again the canopy and the radiant heater can be raised and lowered between upper and lower positions where the radiant heater is energized when in the upper position and the convective system provides the heat to the infant when the canopy and radiant heater are in the lower position.

As a further apparatus, there is disclosed in U.S. patent application Ser. No. 10/672,948 of Falk et al and entitled "Infant Care Apparatus With Fixed Overhead Heater" an apparatus similar to the Jones et al apparatus, however, in the patent application, the radiant heater is in a fixed location above the infant and only the canopy is raised and lowered to convert the function of the apparatus between an infant warmer and an incubator. As such, the disclosure of the Falk et al application is hereby incorporated herein in its entirety by reference.

One of the problems associated with the canopy that can be raised and lowered, is that when the canopy is in its lower position, the canopy must seal against the upper periphery of the protective vertical walls that enclose the infant and, therefore, the lower edge of the canopy needs to be aligned with the upper peripheral edges of those walls so that the infant compartment enclosed therein is well sealed to maintain the desired environment. Accordingly, in the manufacture, and particularly the assembly of the infant warming apparatus, there needs to be certain adjustments made to the orientation of the canopy before it is fully locked into position on the apparatus so that the assembler can ensue that the alignment of the lower edge of the canopy and the upper periphery of the walls is correct.

One system for carrying out such alignment adjustment is shown in U.S. Pat. No. 6,022,310 of Goldberg et al and, and, in that patent, there is a specially constructed alignment mechanism that is located between an overhead arm and the base of that apparatus in order to allow the assembler to carry out the requisite alignment of the canopy and the lower base. In the Goldberg et al patent, the canopy is therefore pre-aligned by allowing certain degrees of movement of the canopy with respect to eh base and then the canopy is tightened into the aligned orientation.

Accordingly, it would be advantageous to have an infant warming apparatus that has an overhead canopy that is movable between an upper position where access can be had to the infant resting on an infant support and a lower position where the canopy encloses the infant support to create an infant compartment within which the infant can be maintained in a controlled atmosphere with a system to carry out the adjustment of the canopy orientation to the base of the apparatus in a plurality of directions.

SUMMARY OF THE INVENTION

The present invention relates to an infant warming apparatus having a base that rests on the floor and which supports the apparatus itself. The base has at least one vertical structural member that extends upwardly and also has an infant support formed on the base to underlie and support an infant being treated by the infant warming apparatus. There is a radiant heater to provide heat to the infant when the infant warming apparatus is functioning as an infant warmer and a convective heating system that provides warmed air to the infant compartment when the infant warming apparatus is functioning as an incubator.

With the present invention, therefore, there is an overhead canopy that can be raised and lowered by the user with respect to the infant support between an upper and a lower position. In the lower position the canopy interacts with the infant support to contain the infant beneath the canopy and the convective heating system can be employed to provide heat to the infant while, in the upper position, the infant is fully accessible and can be attended to by the caregiver and the radiant heater provides the heat to an infant. In the lower position, the lower edge of the canopy engages and remains in contact with the upper peripheral edge of walls that extend upwardly from the infant support on which the infant is positioned.

The canopy that can be used with the invention is preferably constructed of a transparent plastic material and may be formed in the manner shown and described in U.S. Pat. No. 6,419,623, of Dykes et al and entitled "Hood For Infant Care Apparatus".

Accordingly, in order to facilitate the manufacture and assembly of the infant warming apparatus, there is an adjustable mounting system for affixing the canopy to the base such that the adjustable mounting system can allow the movement of the canopy in a plurality of positions and along a plurality of different axes so that the lower edge of the canopy can be oriented so as to seal against the upper periphery of the walls of the infant support and properly and evenly engage the upper periphery of the walls and seal therebetween to effectively form the infant compartment.

The adjustable mounting system of the present invention is therefore located between the canopy and the vertical structural member such that by use of the adjustable mounting system, the canopy, and thus the lower edge thereof, can be adjusted along a plurality of axes in order to properly orient the lower edge in the desired location and then fixed in that desired position by the assembly so that the finished infant warming apparatus is aligned and the canopy fits evenly over the infant compartment to create an infant chamber well isolated from the outside environment.

As an embodiment, the adjustable mounting system can maintain some relative motion between the canopy and the vertical structural member so that the canopy can effectively float or self adjust to the upper peripheral edge of the walls of the infant support in forming the infant compartment and that free relative motion can be both pivotal or linear motion.

These and other features and advantages of the present invention will become more readily apparent during the following detailed description taken in conjunction with the drawings herein.

BRIEF DESCRIPTION OF THE DRAWINGS

FIG. 5 is an exploded view of an embodiment of the adjustable mounting system of the present invention, FIG. 5A is an enlarged cross sectional view of a affixation device used to affix certain components of the FIG. 5 embodiment together;

FIG. 6 is a diagrammatic view showing the various axes used to reference the movement of the canopy in the assembly of the infant warming apparatus;

DETAILED DESCRIPTION OF THE INVENTION

Figure 1:
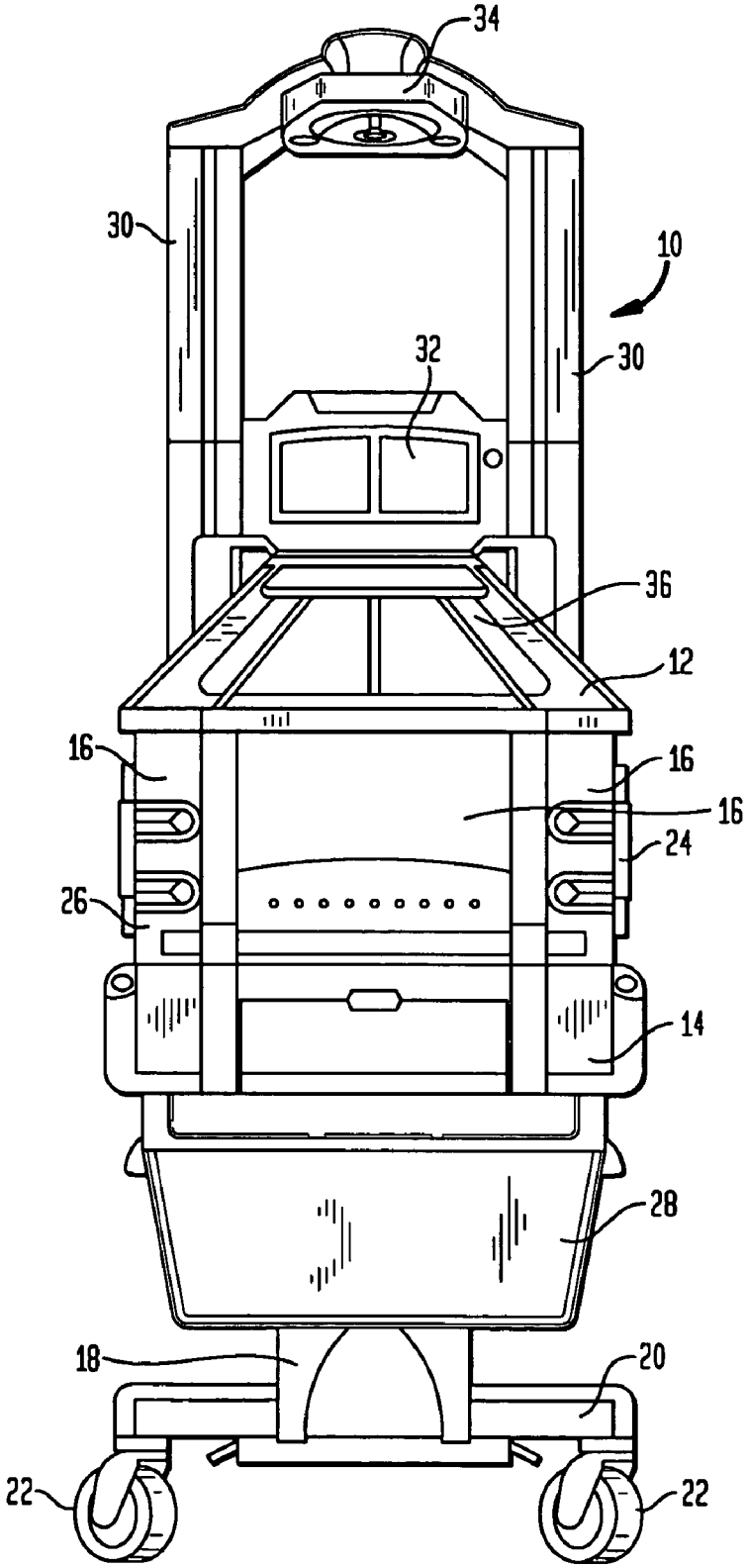
FIG. 1 is a front view of the infant warming apparatus constructed in accordance with the present invention with the canopy shown in its lower position.
Figure 2:
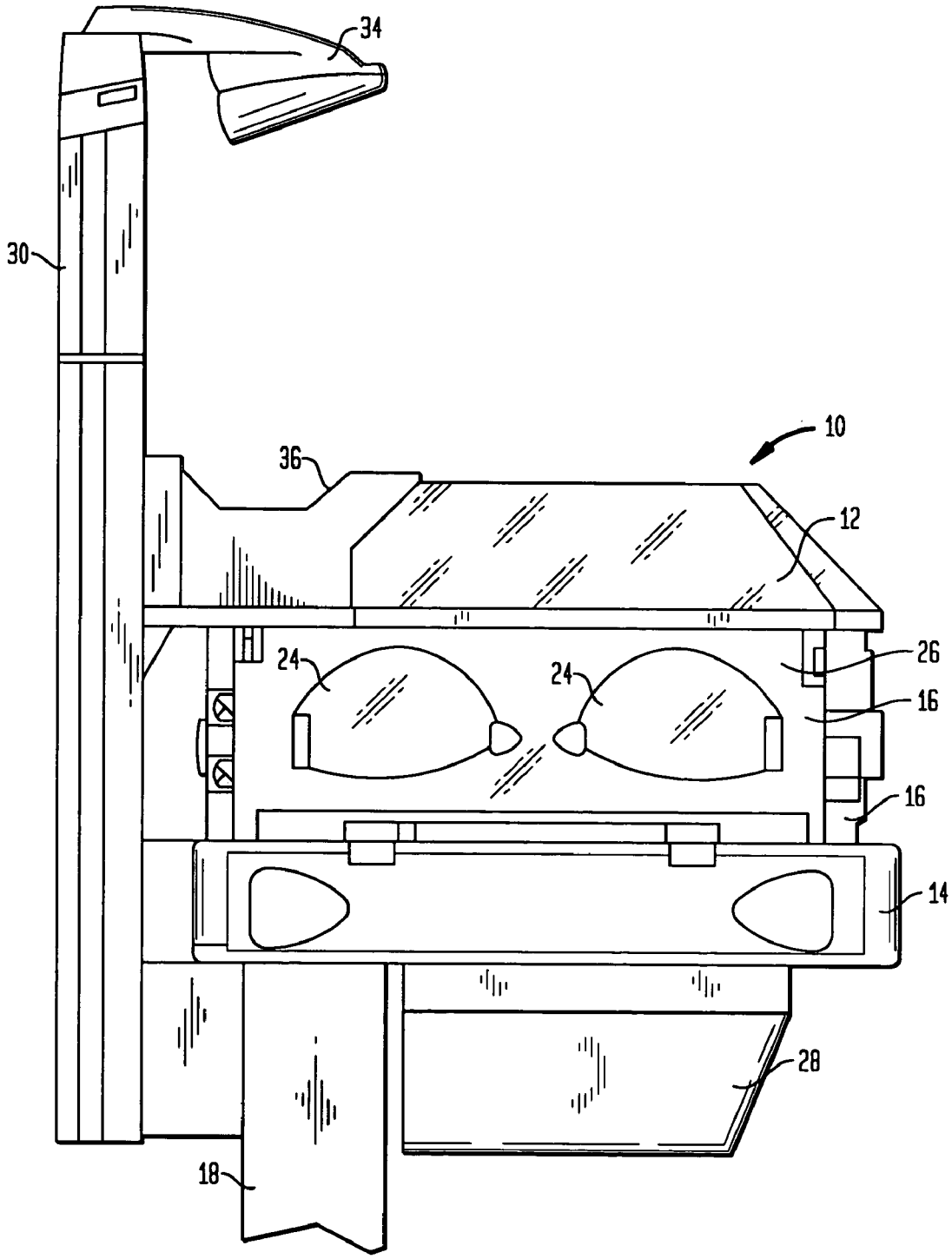
FIG. 2 is a side view of the infant warming apparatus of FIG. 1 with the canopy shown in its lower position.

Referring now to FIGS. 1 and 2, there is shown a front view and a side view, respectively, of an infant warming apparatus 10 constructed in accordance with the present invention with the canopy 12 in its lower position. As will be understood, in FIGS. 1 and 2, the canopy 12 is shown in its lower position wherein the infant warming apparatus 10 acts as an infant incubator with relatively limited access to the infant, as compared to an infant warmer, but with a very controlled environment where the temperature and possibly the humidity and/or oxygen concentration is established and carefully maintained for the wellbeing of the infant.

As shown, the infant warming apparatus 10 includes an infant support 14 that underlies and supports an infant. As is also seen, a plurality of walls 16 are provided to contain the infant safely within the infant warming apparatus 10 and are located at all of the four sides of the infant support 14. The walls 16 are preferable constructed of transparent plastic material and, as will be explained, cooperate with other components in order to provide an incubator function to the infant warming apparatus 10 when in the configuration of FIGS. 1 and 2.

The convective heating system that can be used with the present invention can be a well known and commercially used forced air convective system and one such system that can be used is shown and described in the aforementioned U.S. Pat. No. 6,213,936 of Mackin et al and the necessary apparatus for the convection heating system, such as the heater, fan, humidity control, air ducts and the like are normally located within the infant support 14. That convective heating system then circulates the heated air through the infant compartment that is formed when the present canopy 12 is in its lower position and the infant warming apparatus 10 is carrying out the function of an incubator.

The infant support 14 is mounted to a vertical base member 18 which, in the preferred embodiment, is movably affixed to a stationary vertical base member (not shown), which, in turn, is mounted to a base 20 having wheels 22 for ready movement of the infant warming apparatus 10.

The vertical base member 18 is preferably mounted so that the user can adjust the height of the infant support 14 by raising and lowering the vertical base member 18 as desired, thus the infant support 14 can be adjusted to the preferred height by the user. As further standard features, the walls 16 have handholes 24 to afford access to the infant when in the incubator configuration of FIGS. 1 and 2, and which generally have doors 26, or the walls themselves act as doors, that can be opened to obtain access to the infant and, of course, closed when the particular intervention has been completed to preserve the desired environment surrounding the infant.

Another convenient feature includes a drawer 28 to retain supplies or other devices needed to carry out some operation on the infant and which is normally located beneath the infant support 14. Other features include the maneuverability of the walls 16 that are pivotally mounted at their bases to the infant support 14 such that the doors can be swung outwardly and downwardly and, as a further alternative, can be easily fully removed from the infant support 14. As such, therefore, when the canopy 12 of the infant warming apparatus 10 is in its lower position as shown in FIGS. 1 and 2, the walls 16 can be dropped downwardly or removed altogether so that the attending personnel can have access to an infant resting on the infant support 14 to perform interventions on that infant.

Further structural components of the infant warming apparatus 10 include vertical frame members 30 that are affixed to the base member 18, or other structural component that fixes the vertical frame members 30 with respect to the base 20, and, as shown, there are two vertical frame members 30 in the illustrated embodiment although there may be only one or there may be further numbers of such members.

A control module 32 is conveniently positioned intermediate the vertical frame members 30 and may include displays of various monitored parameters as well as include the various controls for operation of the functions of the infant warming apparatus 10.

A radiant heater 34 is located atop of the vertical frame members 30 and is held there in a fixed position with respect to the infant support 14 so that the radiant heater 34 can always be focused so as to direct the infrared energy toward an infant that is located on the infant support 14. Finally, with respect to FIGS. 1 and 2, there is an opening 36 in the upper surface of the canopy 12 of predetermined dimensions and location and the purpose of the opening 36 will later be explained.

It should be noted that while the radiant heater 34 is shown and described herein as maintained in a fixed location, the radiant heater may also be built into the canopy such that the heater moves with that canopy as the canopy moves between its upper and lower positions in accordance with the infant warming apparatus shown and described in U.S. Pat. No. 6,224,539 of Jones et al, Turning now to FIGS. 3 and 4, there is shown a front view and a side view, respectively, of an infant warming apparatus 10 constructed in accordance with the present invention and where the canopy 12 is illustrated in its upper position. As stated, with the canopy 12 in that upper position, the infant care apparatus 10 functions as an infant warmer where there is full access to the infant and where the overhead radiant warmer 34 supplies heat to maintain the infant with sufficient warmth whereas, in the lower position of FIGS. 1 and 2, the infant warming apparatus 10 functions as a normal incubator, since the lower edge of the infant canopy 12 fits fully over the upper, peripheral edges of the walls 16 to form therein, an infant compartment that is provided with warm air and a controlled environment in the normal functioning of an incubator.

Figure 3:
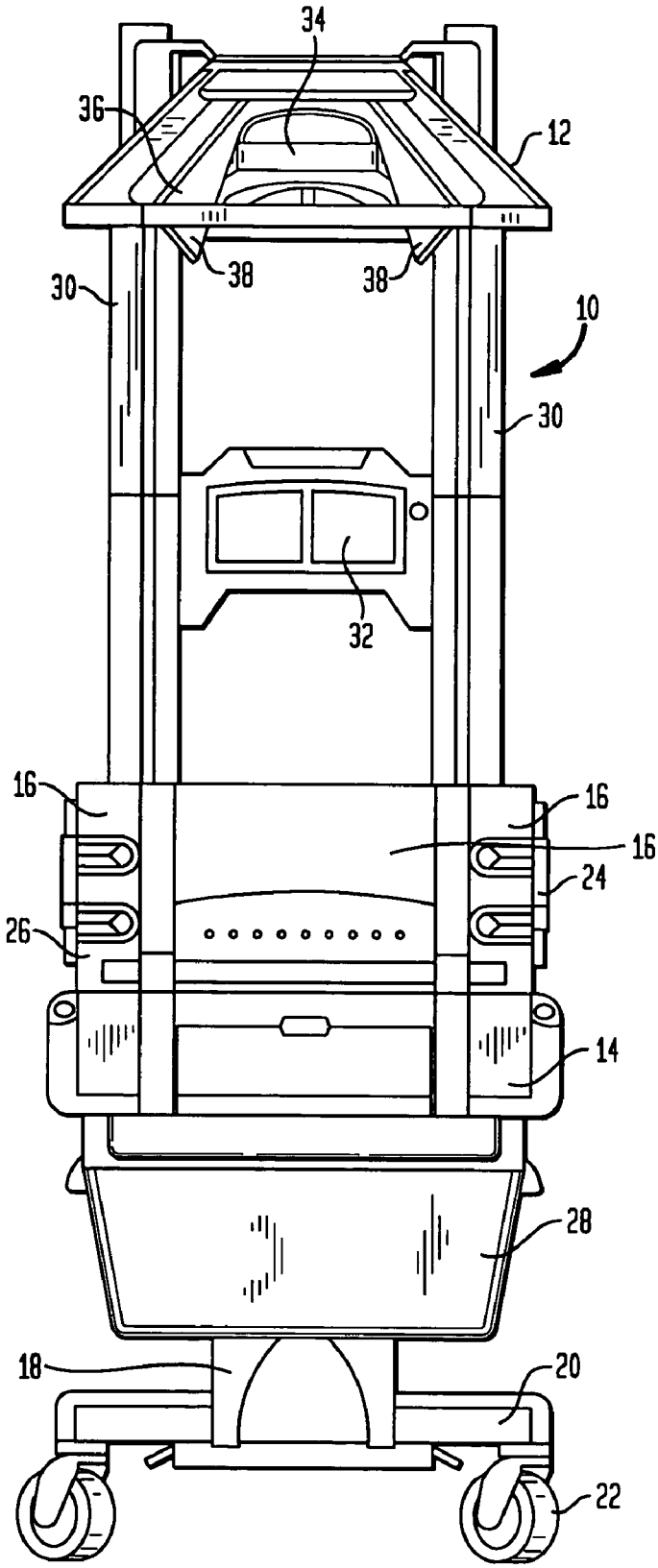
FIG. 3 is a front view of the present infant warming apparatus with the canopy shown in its upper position.
Figure 4:
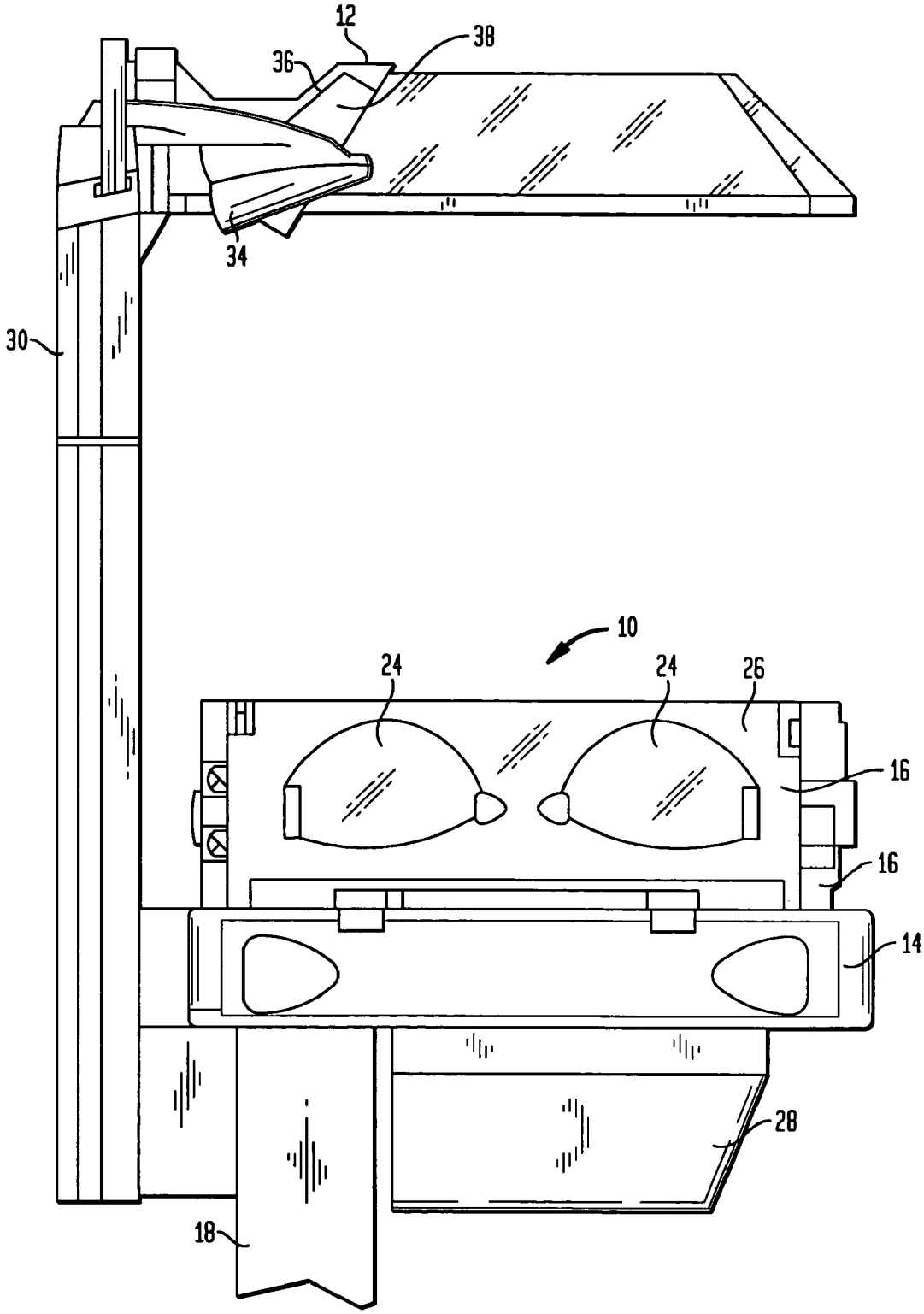
FIG. 4 is a side view of the infant warming apparatus of the present invention with the canopy shown in its upper position.

As may now be seen in general, the canopy 12 can be moved between its lower position as shown in FIGS. 1 and 2 to its upper position as shown in FIGS. 3 and 4 depending upon the mode of operation desired by the user. The elevating and lowering system that can be used to carry out the movement of the canopy 12 between those positions can be the system shown and described in U.S. Pat. No. 6,231,499 of Thomas C. Jones and entitled "Lift Mechanism For Infant Apparatus Canopy" however, any of a variety of other systems can be used to raise and lower the canopy 12 to achieve the results of the present invention.

As also can be seen in FIGS. 3 and 4, the opening 36 that is formed in the canopy 12 is dimensioned and located such that as the canopy 12 moves vertically from its lower position to its upper position, the opening 36 remains aligned with the radiant heater 34 such that when the radiant heater 34 is energized with the canopy 12 in its upper position, the radiant energy can pass directly, that is, unobstructed, from that radiant heater 34 through the opening 36 in a focused path to impinge upon the infant support 14.

Accordingly, the canopy 12 can be located in its upper position thereby allowing unlimited access to the infant to perform interventions on the infant, and yet the radiant heater 36 can serve its purpose of providing heat to the infant resting on the infant support 14. By the specific location and dimensions of the opening 36, the canopy 12 can be raised vertically with respect to the infant support 14, in converting the apparatus from an infant incubator to an infant warmer function yet the radiant heater 34 can remain fixed since the opening 36 in the canopy 12 allows the radiation from that radiant heater 34 to actually pass through the canopy 12.

As a further feature of the infant warming apparatus 10, in the embodiment shown, there is a blocking member, preferably at least one door, and more preferably two doors 38 that are located intermediate the radiant heater 34 and the infant support 14. As shown in FIGS. 3 and 4, the doors 38 are in the open position so that the opening 36 allows the radiant energy to pass therethrough as if the doors 38 were not present.

Turning now to FIG. 5, there is shown an exploded view illustrating the canopy adjustable mounting system constructed in accordance with the present invention. As can be seen, there is a canopy interface bracket 40 that is affixed to the canopy 12 by an affixation device in such a manner that allows an initial adjustability of the canopy 12 with respect to the canopy interface bracket 40 and, of course, with respect to the upper peripheral edges of the walls 15 of FIG. 14.

Taking FIG. 5A, along with FIG. 5, there is shown an enlarged cross sectional view of an affixation device taken along the lines 5A—5A of FIG. 5. In FIG. 5A, there can be seen a pair of clamping discs 42, 44 that can be used to affix the canopy 12 to the canopy interface bracket 40. As such, one of the clamping discs 42 has a cylindrical boss 46 that is internally threaded with female threads and the other clamping disc 44 has a hole 48 having a bolt 50 passing therethrough.

The cylindrical boss 46 interfits snugly through an opening 52 in the canopy 12 and there is an enlarged opening 54 in the canopy interface bracket 40 such that the bolt 50 passes through the enlarged opening 54 to be threaded into the female threads of the cylindrical boss 46. In addition, there are gaskets 56 that are located intermediate the inner surfaces of the clamping discs 42, 44 and the external surfaces of the canopy 12 and the canopy interface bracket 40.

As can now be understood, the affixation devices are used to initially align the canopy 12 to the canopy interface bracket 40 by moving the canopy 12 relative to the canopy interface bracket 40 until the correct alignment is achieved. That relative movement is possible since the enlarged opening 54 is sufficiently larger than the diameter of the bolt 50 so that there is play therebetween. However, once the correct alignment between the canopy 12 and the canopy interface bracket 40 is achieved, the bolt 50 can simply be tightened to exert a force firmly affixing the canopy 12 and the canopy interface bracket 40 together, cushioned by the intermediate gaskets 56.

Turning now to FIG. 6, there is a representation of the various axes for the apparatus in order to describe the relative initial alignment movement of the FIG. 5 embodiment, as well as for the later embodiments to be described. In FIG. 6, there is therefore depicted the orientation of the x axis, the y axis, and the z axis and also there are rotational axes about the those axes, identified, respectively as x', y' and z'.

With the embodiment of FIG. 5, therefore, the canopy 12 can be moved relative to the canopy support bracket 40 in the y direction and rotated or twisted in the x', the y' and the z' directions in order to achieve the desired alignment or mating of the lower edge 58 with the upper periphery of the walls 16 (FIGS. 1–4) in assembling the infant warming apparatus 10 and, when that initial alignment is completed, the bolt 50 is tightened in order to retain the canopy 12 fixed in that orientation. As will also be noted, although only one of the affixation devices is shown specifically, preferably there are a plurality of such devices and may be located at each of the openings 60 on the canopy 12.

There is also a canopy lift bracket 62 as a part of the present adjustable mounting system and which moves upwardly and downwardly as the canopy 12 moves between its upper and lower positions as illustrated in FIGS. 1–4. The canopy lift bracket 62 can be further affixed to a further moving component (not shown) by means of screws that pass through screw holes 64 and into that moving component. There are a plurality of horizontally elongated openings 66 formed in the canopy lift bracket 62 that align, individually, with a plurality of vertically elongated openings 68 formed in the canopy interface bracket 40 (only one set of which is shown) and, during assembly screws 70 and mating nuts 72 are used with the screws 70 passing through the horizontally elongated openings 66 and the vertically elongated openings 68 in assembling the canopy interface bracket 40 and the canopy 12 to the canopy lift bracket 62. Again for illustrative purposes, only one set of screws 70 and mating nuts 72 are shown in FIG. 5, it being understood that two oppositely disposed sets are normally utilized.

As such, the initial affixing of the canopy interface bracket 40 to the canopy lift bracket 62 allows those components to be adjusted along both the x and the y axes of FIG. 6 since there can be relative movement between the canopy lift bracket 62 and the canopy interface bracket 40 at the junction therebetween along both the horizontal and vertical directions. Once the initial alignment is determined and correctly established, the mating nuts 72 are simply tightened and the canopy 12 is thereby fixed in the desired orientation along those directions.

Accordingly, between the junction between the canopy interface bracket 40 and the canopy 12 and also the junction between the canopy interface bracket 40 and the canopy lift bracket 62, the full range of relative motion of the canopy 12 includes movement in the x, y and z directions and rotation in the x', y' and z' directions, thereby allowing the assembler to move the canopy 12 in all of the relevant directions to achieve the correct alignment with respect to the fixed, upper peripheral edges of the walls 16, and then fixing the canopy 12 in that particular orientation.

As can be readily understood, the location of the horizontally elongated openings 66 on the canopy lift bracket 62 and the vertically elongated openings 68 on the canopy interface bracket 40 can be reversed, that is, with the horizontally elongated openings 66 being on the canopy interface bracket 40 and the vertically elongated openings on the canopy lift bracket 62. Also, while the enlarged opening 54 is shown in FIG. 5A to be formed in the canopy interface bracket 40, it can as easily be in the canopy 12 with the smaller opening formed in the canopy interface bracket 40 and still carry out the purposes and intent of the present invention.

Figure 7:
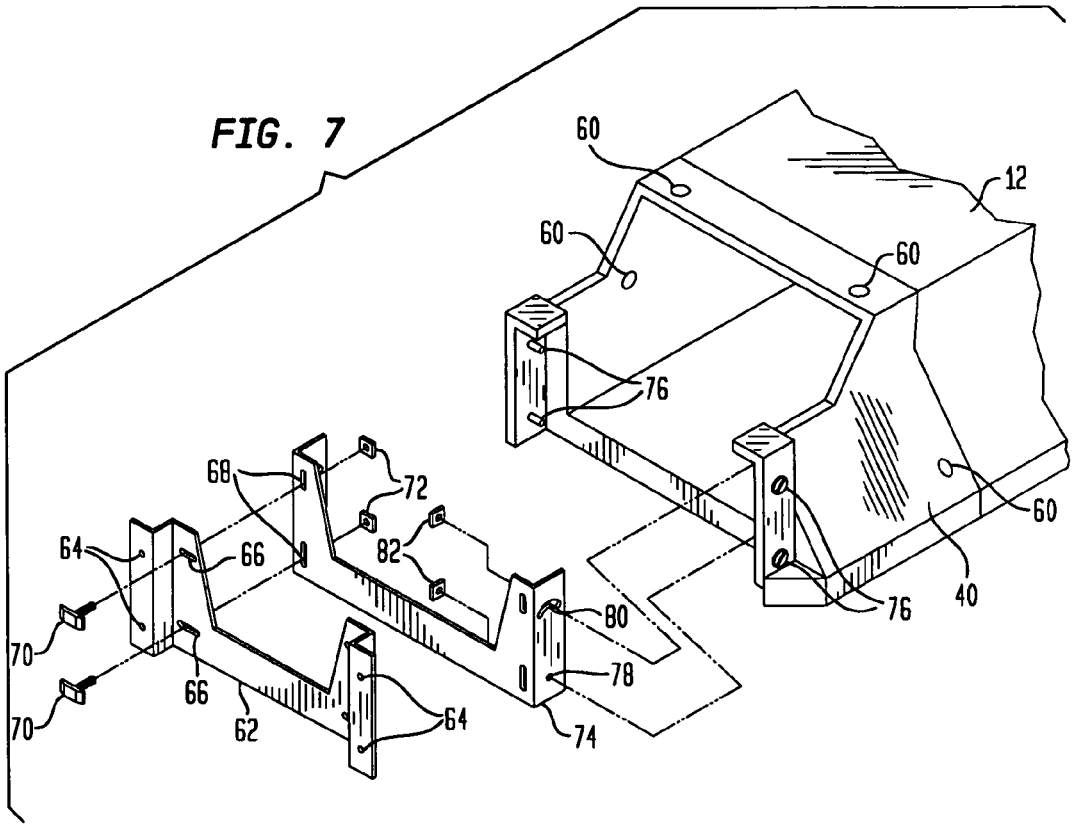
FIG. 7 is an exploded view of a further alternative embodiment of the adjustable mounting system of the present invention.

Turning now to FIG. 7, there is shown a further embodiment of the present invention, and since many of the components illustrated in FIG. 7 are the same as shown in FIG. 5, like numbers have been assigned to those components. In the embodiment of FIG. 7, however, there is an additional bracket added to the adjustable mounting system and is shown as a pivot bracket 74 that is positioned intermediate the canopy lift bracket 62 and the canopy interface bracket 40.

As in the prior embodiment, there are vertically elongated openings 68 formed in the pivot bracket 74 that mate with horizontally elongated openings 66 in the canopy lift bracket 62 to create that connection having adjustability in the x and y directions of FIG. 6. In addition, however, in this embodiment, the canopy 12 can be freely titltable in the x' direction by means of the connection between the canopy interface bracket 40 and the pivot bracket 74.

That tiltable connection between the canopy interface bracket 40 and the pivot bracket 74 is carried out by means of a pair of vertically spaced apart pins 76 located so as to be pointed inwardly from the inner edge of the canopy interface bracket 40. The lower of the pins 76 passes through an opening 78 in the external edge of the pivot bracket 74 and the upper of the pins 76 pass through a curved or arcuate opening 80 also formed in the pivot bracket 74.

Again, openings 78 and 80 are only shown at one end of the pivot bracket 74, it being understood that a mirror image set of openings are located oppositely disposed at the other end of pivot bracket 74.

The arc of the arcuate opening 80 has a radius with the opening 78 located at its center point such that when the pins 76 pass through the respective openings 78, 80, canopy interface bracket 40 and therefore, the canopy 12 can pivot about the openings 78, that is, about the x' direction, as referenced in FIG. 6, such that the canopy 12 is freely tiltable along that axis and will seat itself using the tiltable degree of freedom when the canopy 12 encounters the upper peripheral edge of the walls 16 (FIGS. 1–4). Accordingly, with the use the additional pivot bracket 74, the tilting of the canopy 12 in the x' direction is facilitated and it is free to tilt to the necessary degree as the canopy is lowered to its lower position.

As an alternative, instead of allowing the canopy to freely tilt to find its own orientation against the upper peripheral edge of the walls 16, the connection between the pivot bracket 74 and the canopy interface bracket 40 can be carried out by means of threaded screws replacing the pins 76 that are mated with nuts 82 so that, once initially adjusted to the desired tilt angle, the nuts 82 can be tightened in order to retain the canopy 12 at the particular tilt angle.

Figure 8:
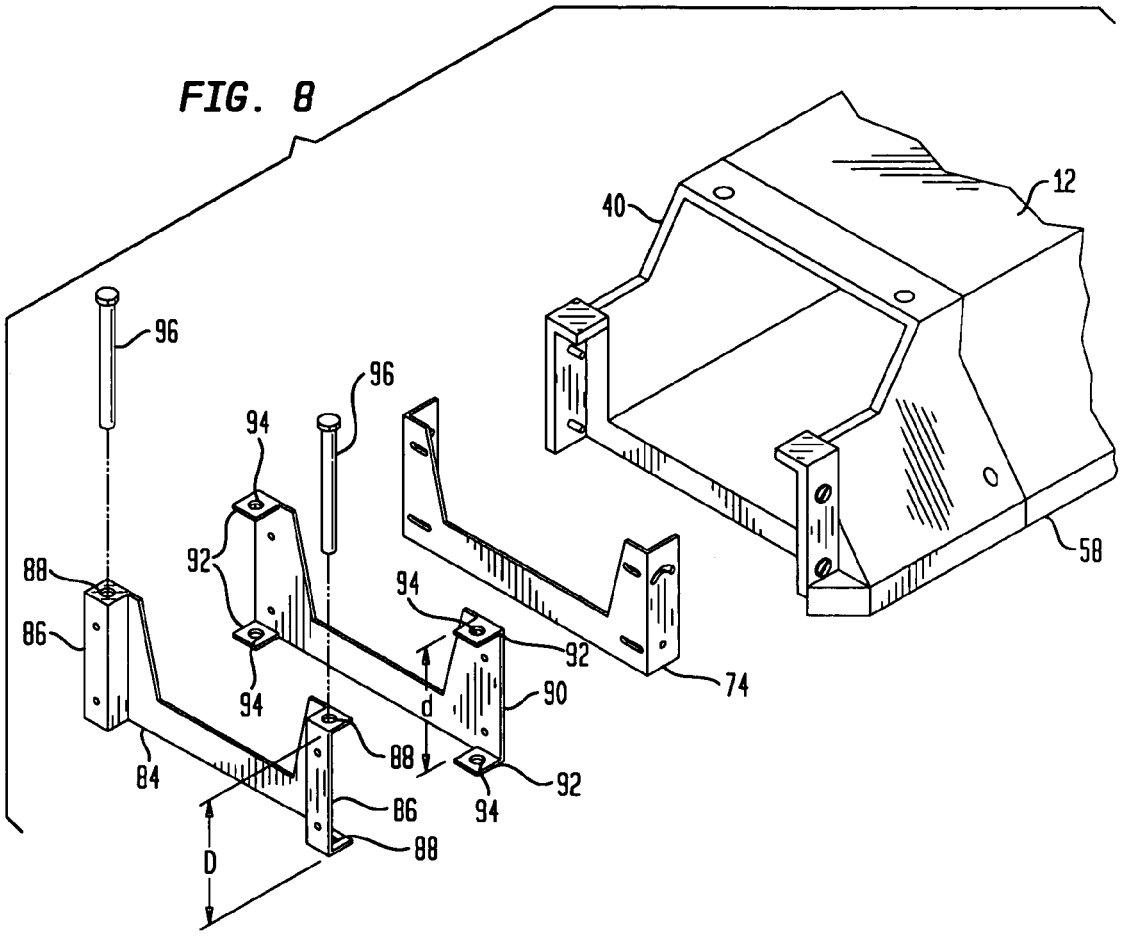
FIG. 8 is an exploded view of a still further alternative embodiment of the adjustable mounting system of the present invention.

Turning finally to FIG. 8, there is an exploded view of a further embodiment of the present invention. In this embodiment, the pivot bracket 74 functions in the same matter as with the prior FIG. 7 embodiment, however, there is a different design of the canopy lift bracket 84. The canopy lift bracket 84 has oppositely disposed end flanges 86 having holes 88 that are vertically spaced apart and which are generally in vertical alignment. Likewise, there is a slider bracket 90 that also has end flanges 92 having holes 94 that are in vertical alignment and are vertically spaced apart.

The distance D between the holes 88 in the canopy lift bracket 84 is greater than the distance d between the holes 94 in the slider bracket 90. As such, the slider bracket 90 can be affixed to the canopy lift bracket 84 by means of slider pins 96 that slide respectively through the holes 88 and 94 that are aligned with each other such that the end flanges 92 of the slider bracket 90 are positioned inside the end flanges 86 of the canopy lift bracket 84 and, due to the difference in the dimensions D and d, the slider bracket 90 can slide a predetermined vertical distance with respect to the canopy lift bracket 84, that is, along the z axis.

According as the canopy 12 is lowered to its lower position, as in FIGS. 1 and 2, there is some free movement of the canopy 12 along the z axis so that the lower edge 58 of the canopy 12 is free to locate itself, by means of that vertical play, against the upper peripheral edges of the walls 16.

By the provision of the vertical play of the canopy 12, the canopy 12 can be lowered down to its lower position, of FIGS. 1 and 2, and the canopy 12 will basically float as it sits upon the upper peripheral edge of the walls 16 so that the vertical adjustment, that is, along the z axis, as well as the rotational axes, do not have to be critically controlled such as with the FIGS. 5 and 7 embodiments.

Since the angular orientation of the canopy 12 is also allowed to float to find its proper seating angle along the x' axis as described with respect to FIG. 6 with the use of the tilt bracket 74, it can be seen that the canopy 12, in this embodiment, is free to both move in the vertical or z direction as well as about the x' axis and thus is free to move in at least two different directions in seating against the upper peripheral edge of the walls 16 (FIGS. 1–4).

Those skilled in the art will readily recognize numerous adaptations and modifications which can be made to the infant warming apparatus of the present invention which will result in an improved assembly thereof, yet all of which will fall within the scope and spirit of the present invention as defined in the following claims. Accordingly, the invention is to be limited only by the following claims and their equivalents.

I claim:

1. An Infant warming apparatus, said infant warming apparatus comprising a base, an infant support located on said base adapted to support an infant thereon, a canopy lift bracket movably affixed to said base in a vertical direction, a canopy, said canopy affixed to said canopy lift bracket to move said canopy between a lower position wherein said canopy fits over said infant support to form an infant compartment adapted to enclose an infant and an upper position wherein said canopy is elevated with respect to said infant support and the infant compartment is open, said canopy being affixed to said canopy lift bracket by means of an adjustable mounting system comprising a canopy interface bracket affixed to said canopy, and a pivot bracket positioned intermediate said canopy interface bracket and said canopy lift bracket and wherein said canopy interface bracket is pivotally affixed to said pivot bracket whereby said pivot bracket allows the canopy to freely pivot against the infant support when said infant compartment has been formed, said adjustable mounting means further including a slider bracket positioned intermediate said pivot bracket and said canopy lift bracket wherein said slider bracket is vertically movable with respect to said canopy lift bracket.

2. The infant warming apparatus as defined in claim 1 wherein said base includes a vertical structural member extending upwardly from said base and said canopy lift bracket is affixed to said vertical structural member.

3. The infant warming apparatus as defined in claim 1 wherein said canopy interface bracket is pivotally affixed to said pivot bracket by pins passing through vertically spaced apart openings in opposed ends of said pivot bracket or said canopy interface bracket, one of said openings having an arcuate configuration and wherein said canopy is pivotable about the other of said openings.

4. The infant warming apparatus as defined in claim 3 wherein said openings are in said pivot bracket.

5. The infant warming apparatus as defined in claim 1 wherein the relative free motion between said slider bracket and said canopy lift bracket and between said pivot bracket and said canopy interface bracket allows the canopy to move vertically and pivotally against the infant support in forming the infant compartment.

6. The infant warming apparatus as defined in claim 1 wherein said canopy includes a radiant heater.

7. A method of attaching a canopy to a base in an infant warming apparatus, said method comprising the steps of:

providing an infant warming apparatus having a base and an infant platform supported by the base, providing a canopy supported by the base and adapted to be movable with respect to the base between a lower position forming an enclosed infant compartment with said infant support, and an upper position where the infant compartment is open, providing an adjustable mounting system intermediate the canopy and the base, the canopy mounting system having a canopy lift bracket that is mounted to the base so as to move vertically as the canopy is moved between its upper and lower positions, a canopy interface bracket and a pivot bracket intermediate the canopy interface bracket and the canopy lift bracket and a slider bracket intermediate the pivot bracket and the canopy lift bracket, and connecting the slider bracket to the canopy lift bracket to allow vertical motion therebetween and securing the canopy with respect to the base while allowing a loose connection between the interface bracket and the pivot bracket to allow pivotal motion therebetween whereby the canopy floats atop of the infant platform when the infant compartment is formed.

8. The method of claim 7 wherein the step of providing an adjustable mounting system includes the step of connecting the slider bracket to the canopy lift bracket to allow vertical and pivotal motion therebetween.

* * * * *